United States Patent [19]

Birkhofer et al.

[11] 4,199,094

[45] Apr. 22, 1980

[54] MACHINE FOR THE ATTACHMENT OF RIVETS, BUTTONS, OR THE LIKE

[75] Inventors: Herbert Birkhofer, Brunswick; Metin Ersoy, Wuppertal, both of Fed. Rep. of Germany

[73] Assignee: Schaeffer-Homberg GmbH, Wuppertal, Fed. Rep. of Germany

[21] Appl. No.: 926,883

[22] Filed: Jul. 21, 1978

[30] Foreign Application Priority Data

Jul. 21, 1977 [DE] Fed. Rep. of Germany ..... 2732900
Jun. 3, 1978 [DE] Fed. Rep. of Germany ..... 2824439

[51] Int. Cl.[2] ..... B21J 15/10

[52] U.S. Cl. ..... 227/37; 222/254; 222/130; 227/107; 227/48

[58] Field of Search ..... 227/31, 32, 51, 53, 227/55, 56, 102, 109, 37, 48; 222/124, 126, 130, 155, 164, 165, 254

[56] References Cited

U.S. PATENT DOCUMENTS

| | | | |
|---|---|---|---|
| 455,552 | 7/1891 | Welton | 221/164 X |
| 483,849 | 10/1892 | Marsden | 221/130 |
| 502,895 | 8/1893 | Van Norman | 221/164 |
| 679,434 | 7/1901 | Sisson | 221/130 X |
| 3,069,938 | 12/1962 | Andrycha et al. | 227/109 |
| 3,435,833 | 4/1969 | Tanaka | 227/155 X |
| 3,934,777 | 1/1976 | Kramer et al. | 227/109 |

FOREIGN PATENT DOCUMENTS

| | | | |
|---|---|---|---|
| 413937 | 5/1925 | Fed. Rep. of Germany | 221/164 |
| 448415 | 8/1927 | Fed. Rep. of Germany | 221/165 |

*Primary Examiner*—Paul A. Bell
*Attorney, Agent, or Firm*—Martin A. Farber

[57] ABSTRACT

A machine for the attachment of rivets, buttons, or the like, particularly to clothing pieces, with an upper tool and a lower tool and with magazine chambers for upper and lower parts, from which chambers the upper and lower parts, respectively, are brought via feed rails into the region of the working position. The magazine chambers are arranged floor-like one above the other. A single slide is coordinated to both chambers, the slide being moved up and down in front of the rear wall of the chambers. On its front wide face the slide is equipped with stroke and sorting ledges which are inclined downwardly in the direction of one of the side walls. In the upper position the ledges lie flush in alignment with the discharge openings of the magazine chambers - side walls.

10 Claims, 11 Drawing Figures

Figure 1:
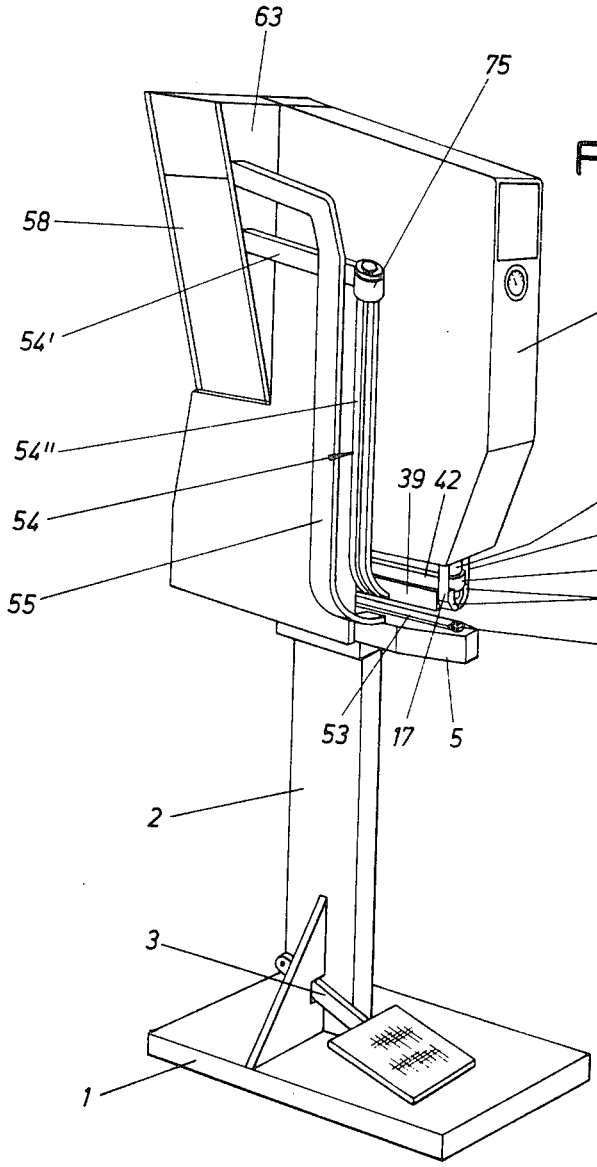

FIG.9
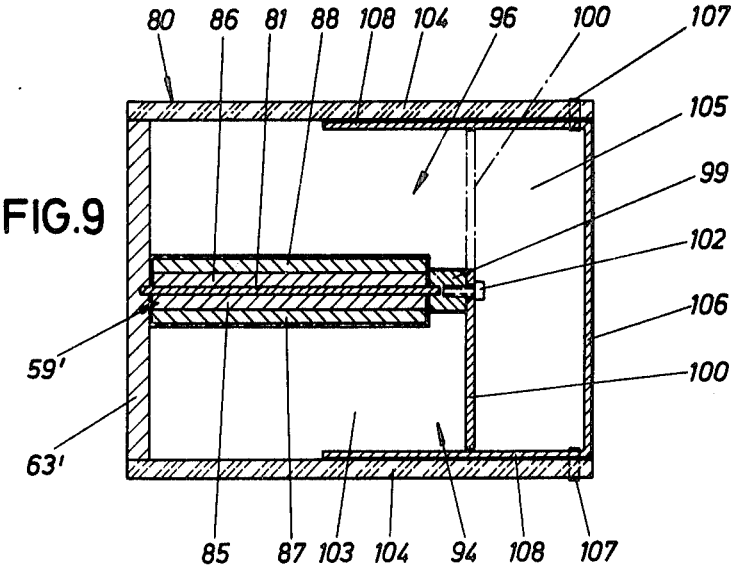
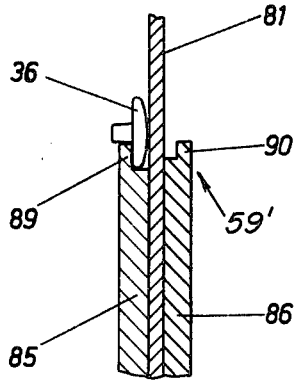
FIG.10
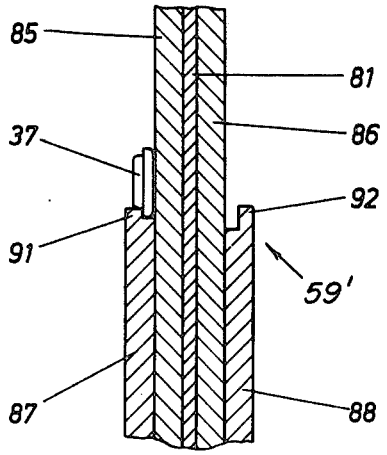
FIG.11

MACHINE FOR THE ATTACHMENT OF RIVETS, BUTTONS, OR THE LIKE

The invention relates to a machine for attachement of fasteners, such as rivets, buttons, or the like, particularly to clothing pieces, with an upper tool and lower tool and with magazine chambers for upper and lower parts of the fasterners, from which chambers the upper and lower parts, respectively, are brought via feed rails into the region of the working position.

By the German Gm 7, 329, 772 (corresponding to U.S. Pat. No. 3,934,777) drum-like magazine chambers are known for the upper and lower parts, which magazine chambers can be attached on both sides of the machine. If different shaped rivets, snap buttons or the like are to be worked by means of other machine, the corresponding magazines are to be attached. This formation however requires a considereable spacial requirement and is expensive to manufacture.

The subject of the invention is based on the task to provide a machine of the previously set forth type of construction which is simple in production and which is advantageous in use, such that without reduction of the reception volume only a small spacial requirement for the magazine chambers exist.

With the invention the magazine chambers (e.g., 56,57) are arranged floor or level-like one above the other and a single slide (5) is coordinated to both chambers, the slide being moved up and down in front of the rear wall (58) of the chambers, which slide on its front wide surface is equipped with stroke and sorting ledges (64,65) which are inclined downwardly in the direction of one of the side walls (e.g., 63), the ledges lying in the upper position flush in alignment with the discharge openings (68,69) of the side walls of the magazine chambers.

As a result of such formation a machine of the introductory type is provided which on the one hand is characterized by a very simple construction and on the other hand conserves space. Since the magazine chambers lie one above the other like floors or at different levels, only a single slide need be provided. The production expense thereby is considerably reduced. During its downward movement the slide penetrates into the supply, the supply comprising fastener upper and lower parts, respectively, stored in the chambers, while during its upward movement the stroke and sorting ledges (which are provided on the wide surface of the slide) bring the upper and lower parts, respectively, aligned in front of the discharge openings of the side walls of the magazine chambers. Depending on the downwardly inclined course of the stroke and sorting ledges, the upper and lower parts roll or slide, respectively, automatically through the discharge openings and arrive from there into the feed rails, the latter conducting the upper and lower parts to the working position. Preferably also the rear wall of the magazine chambers are inclined, so that the likewise correspondingly inclined slide guarantees a sure holding of the upper and lower parts, which parts are carried by the stroke and sorting ledges.

An advantageous feature according to the invention is that the feed rails (54,55) which originate from the discharge openings (68, 69) receive the parts (36,37) in the vertical rolling position. That considereably facilitates the transportation of the upper and lower parts, respectively. On the feed rails no specially driven conveying construction parts are required.

According to the invention it is advantageous if one of the feed rails (e.g. 54) in the range of its transition from a downwardly inclined section (54') to a vertical section (54'') has a turning position (75), the turning position being a helical or coil-shaped track guide.

The stroke (or lift) and sorting ledges can have the most favorable cross-sectional shape. This permits e.g. that continually the cross-sectionally larger flange of the fastener parts to be transported can face the wide face of the slide. The upper part and lower part, respectively, at the turning position (75) are correspondingly aligned before they are fed to the working position. Consequently with rivet-type upper parts it is guaranteed that the upper part which is transported into the clamping fingers or jaws enters with its pins directed downwardly.

Furthermore it is favorable for the discharge openings (68, 69) to be made of exchangable or replaceable profile members (70, 71).

For differently shaped upper and lower parts, respectively, the magazine does not need to be exchanged. Simply an exchange of the profile members is to take place. Possibly with an exchange of the same also an exchange of the stroke and sorting ledges can be accomplished.

Advantages in charging are brought about when the lower magazine chamber (57) opens upwardly via a fill-up shaft (74), the latter passing in front of the upper magazine chamber (56). The filling or refilling of the magazine shafts can thus take place from one place.

In order to guarantee complete removal or discharge of the magazine chambers, in the lower reversing position of the slider movement the lift and sorting ledges penetrate into the bottom or floor of the magazine chamber.

In order now to improve a machine of the previously set forth type, such that with a construction which is simple in manufacture, an increased range of use is obtained, it is proposed in accordance with the invention, to equip the slide on its rear side also with downwardly inclined stroke and sorting ledges (90, 92), to which ledges there is coordinated a magazine chamber (95 and 96, respectively) of their own, that the side walls of the magazine chambers, which side walls are coordinated to the two-sided stroke and sorting ledges (89, 90, 91 and 92), are selectively closeable, and that a transfer or cross-over chamber (105) is adjacent to both of the magazine chambers (93, 95 and 94, 96, respectively) on the other side of the narrow edge of the slide (59), which transfer chamber by means of a reversible transverse wall (100) is able to be spearated alternately from one or the other magazine chamber, respectively, while leaving free a reduced passage cross-section.

Now with the machine, with slight changes, four different rivet parts are able to be worked. If for example the machine is to be changed over for use with a different type of rivet parts, simply the transverse wall is to be reversed or turned around, the profile pieces which have the discharge openings for the rivet parts are to be replaced, correspondingly shaped feed rails are to be attached and adjusted tools are to be attached. This operation may be carried out in a short period of time. Also this embodiment permits a large storage volume. The latter is composed of one of the magazine chambers, the transfer chamber and the magazine chamber which stands in connection with the discharge opening. Nevertheless a narrow construction of the machine is possible, since the magazine can be lengthened or extended toward the rear. The transverse wall which acts as a separation and dosing wall insures that the magazine chamber which is coupled respectively from time to time with each feed rail contains so many rivet parts that the feeding by means of the sorting ledges is not impaired.

An advantageous feature is that the reduced passage cross-section is changeable by displacement of the height or level of the transverse wall (100). Thereby in a simple manner the passage cross-section may be varied. For example the transverse wall can have a longtiudinal slot, through which slot a set screw is inserted. After releasing the set screw, then the appropriate height position of the transverse wall is able to be fixed.

Finally an advantageous feature is still to be seen in that the walls of the transfer chambers are formed as filling and emptying flaps.

The feeding of rivet parts is extraordinarily simplified in this manner. After swinging the flaps open, funnel-shaped openings are present, in which openings the rivet parts can be easily charged. In the completely open position these flaps facilitate the complete emptying of the magazine chambers, for example in order to be able to perform a change. Preferably the side walls of the magazine chambers are made of transparent material so that the filling level of the magazine chambers can be recognized.

A complete emptying of the chambers is most simply achieved if one of the upper and lower ledges (89, 90 and 91, 92) respectively is inclined to the discharge opening side and the other to the transfer chamber (105).

Figure 2:
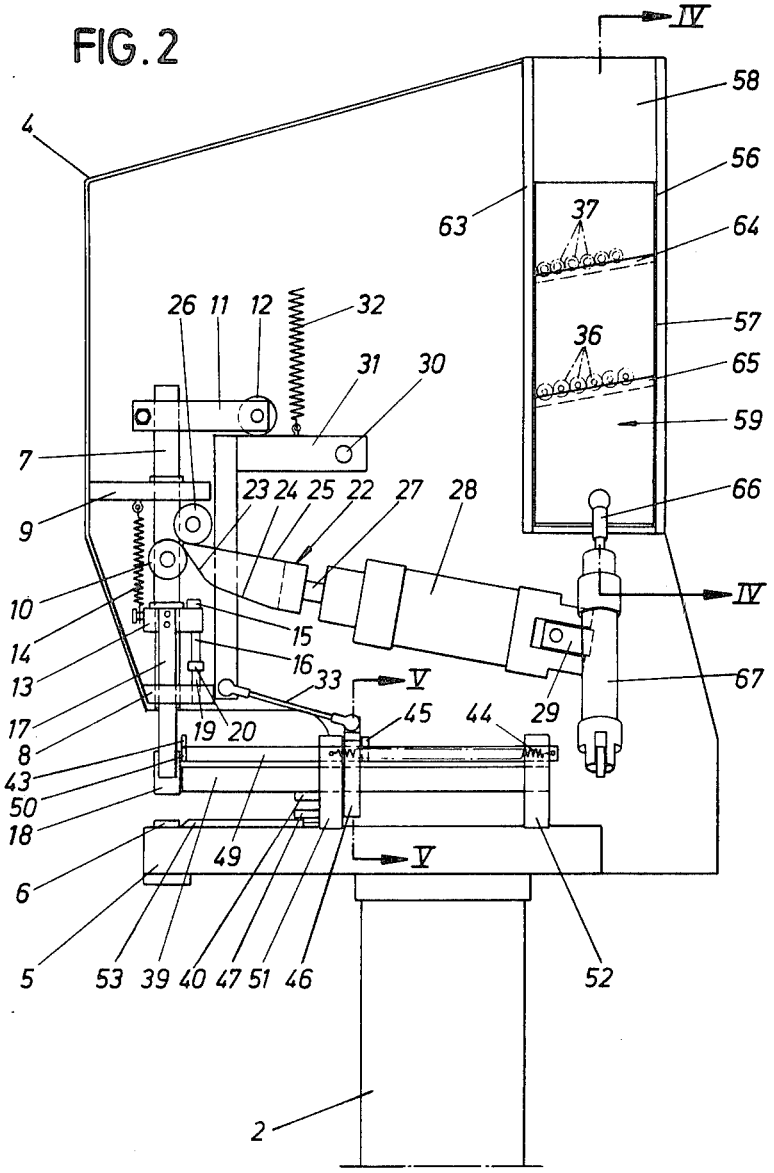
Figure 3:
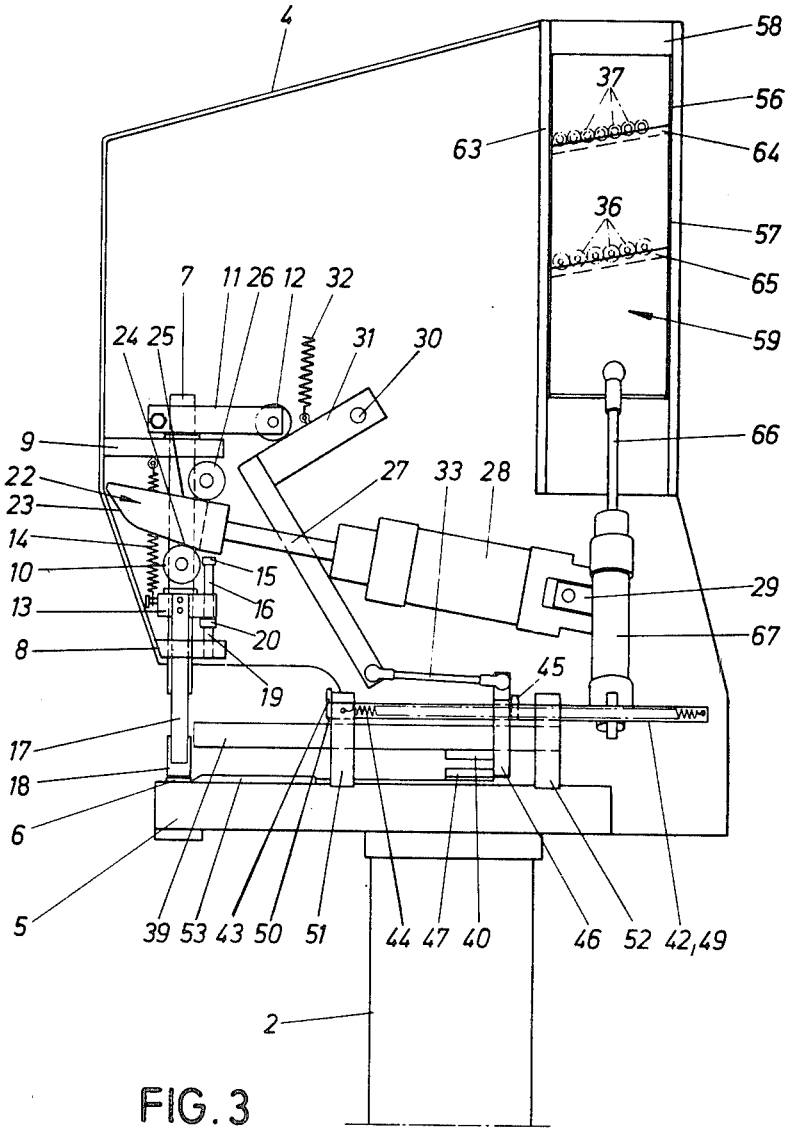
Figure 4:
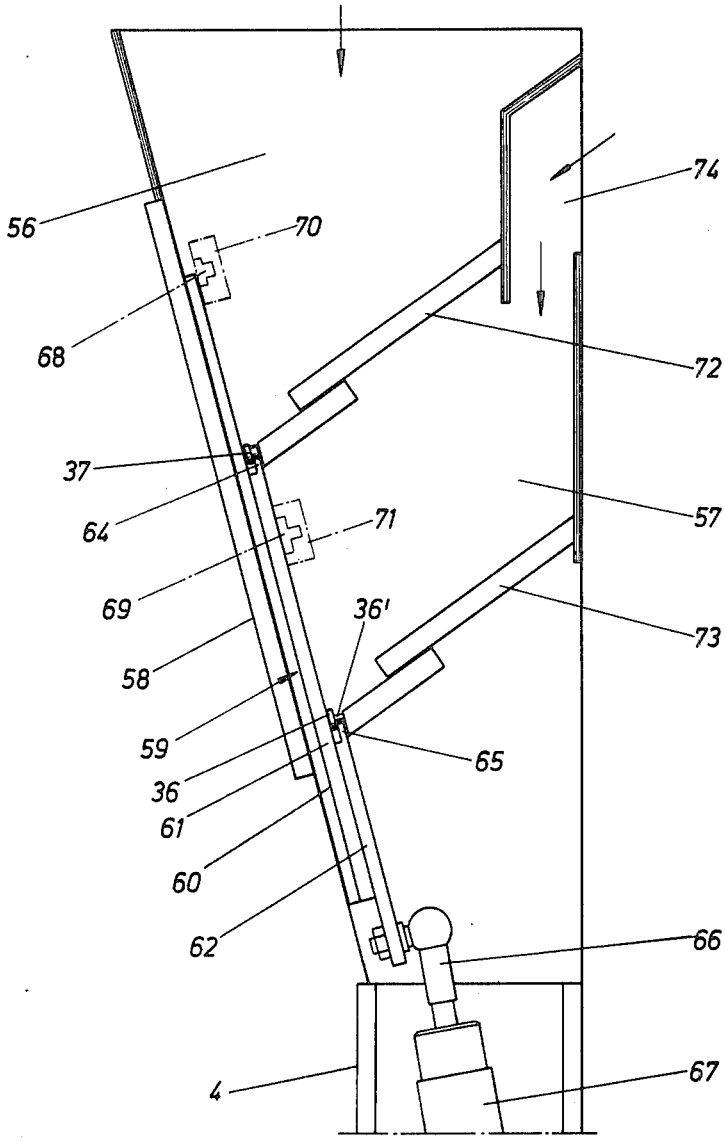
Figure 5:
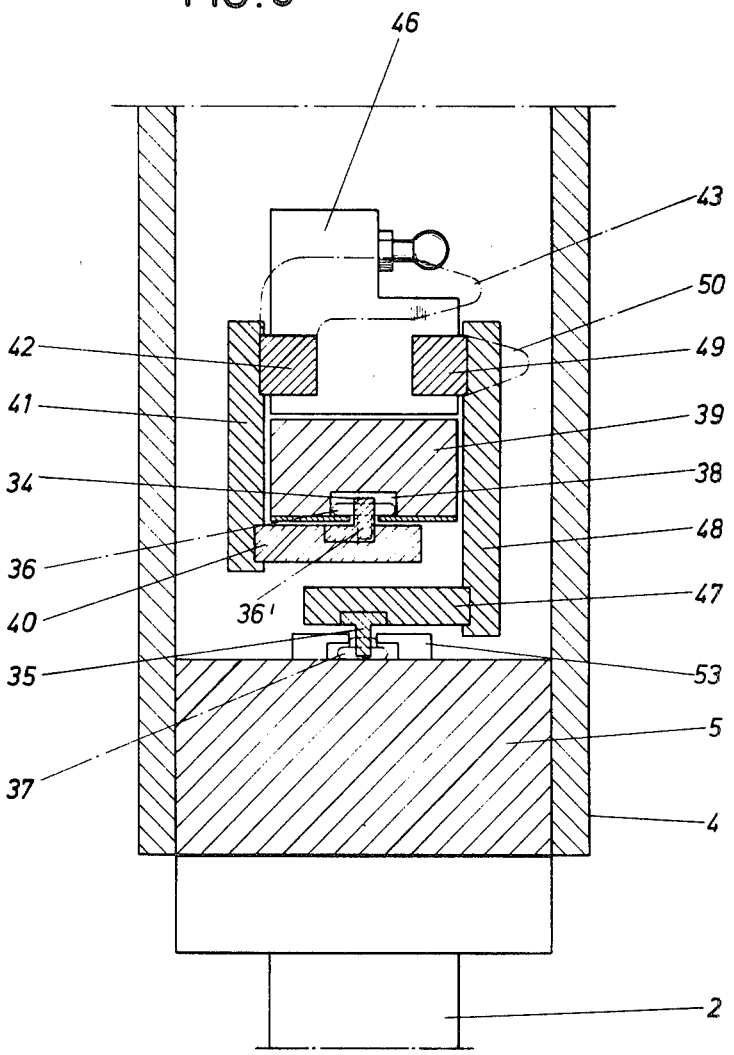
Figure 6:
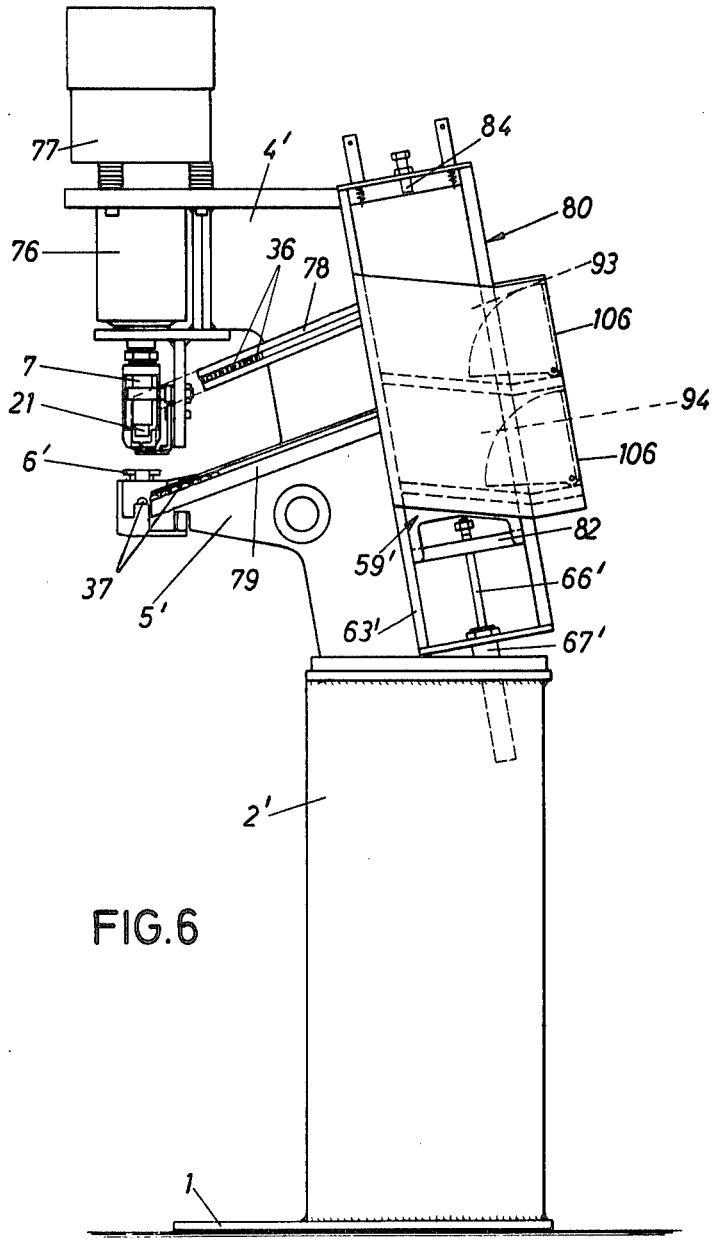
Figure 7:
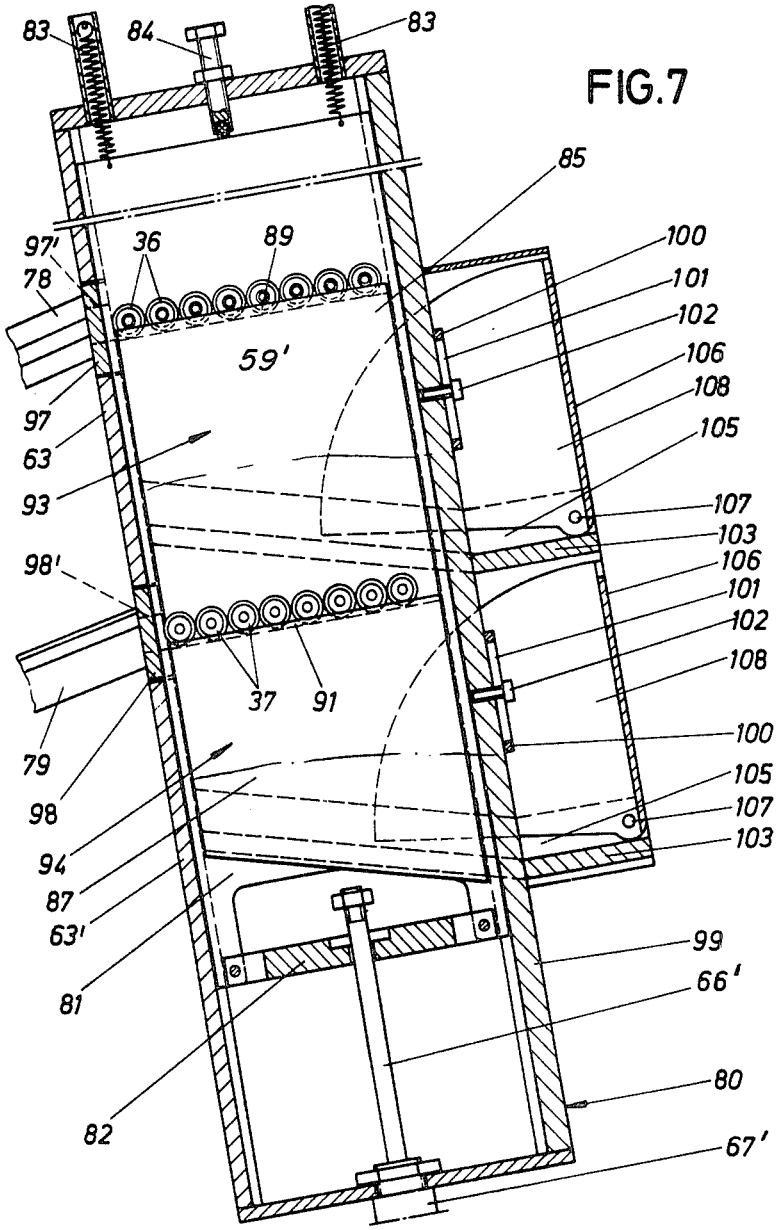
Figure 8:
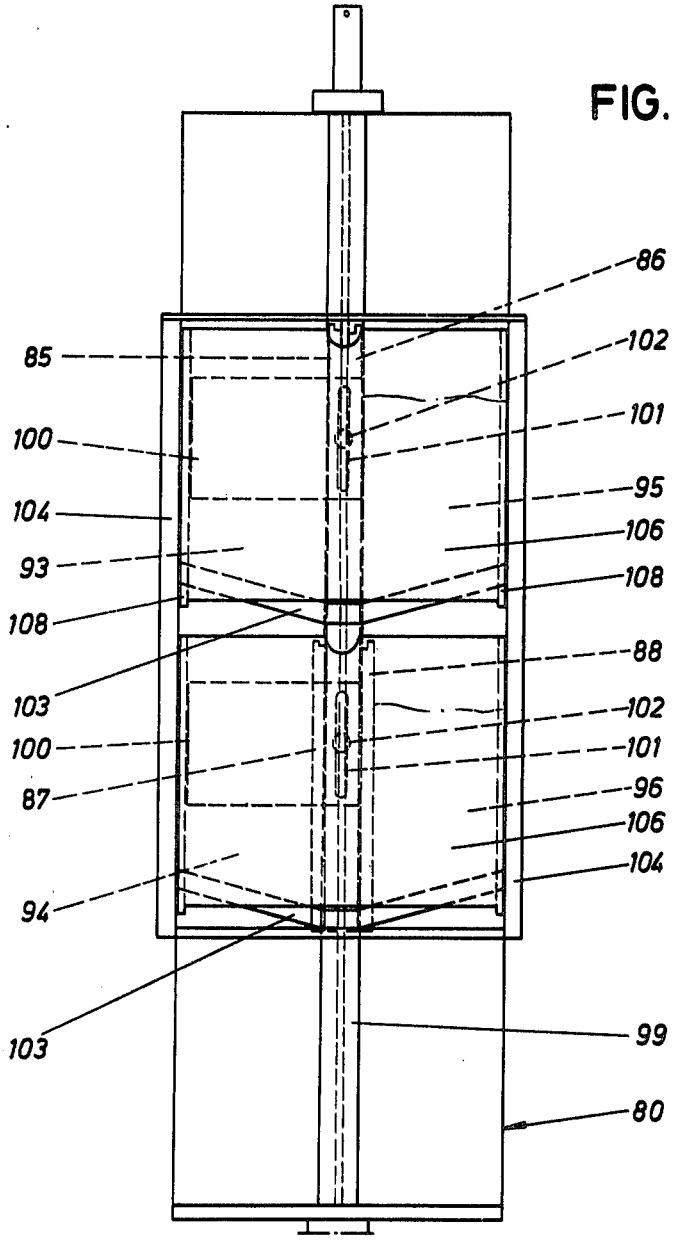

With the above and other objects and advantages in view, the present invention will become more clearly understood in connection with the detailed description of preferred embodiments, when considered with the accompanying drawings, of which:

FIG. 1 is a perspective illustration of the machine in accordance with the invention, FIG. 2 is a side view toward the drive of the machine in the base or normal position of the same, FIG. 3 is an illustration corresponding to FIG. 2, whereby the wedge has moved the ram downwardly, FIG. 4 is the section according to the line IV—IV in FIG. 2, FIG. 5 is the section according to the line V—V in FIG. 2, FIG. 6 is a side view of another embodiment of the improved machine, FIG. 7 is a longitudinal section of FIG. 6 through the magazine parallel to the plane of the slide, FIG. 8 is a rear view of the magazine of FIG. 6, FIG. 9 is a cross-section through the magazine of FIG. 6, FIG. 10 is a longitudinal section through the slide of FIG. 6 through its upper range, and FIG. 11 is a longitudinal section through the slide of FIG. 6 in its lower range.

As FIG. 1 shows, this relates to a machine which is suited for operation while sitting, i.e., the level of the work is adjusted to the existing standards. The machine could also be made such that the working level corresponds to the norm or standard for a standing manner of operation.

In particular the machine has the machine stand or pedestal 2, the latter being carried by the base plate 1. The foot level 3 is mounted on the machine stand 2. By means of the connection rods (not illustrated), the foot lever starts the working stroke of the machine.

The machine housing 4 is seated on the stand 2. The machine housing on the lower side contains the projecting arm 5, the latter carrying the lower tool 6 on the front end.

The ram 7 extends flush in alignment with the lower tool 6. The ram 7 is guided in two pedestals or bearing blocks 8 and 9 on the sides of the machine. In the vicinity between the pedestals 8 and 9 there is located a roller 10, the latter being mounted on the ram 7. The end of the ram which extends above the pedastal 9 carries the clamped-on abutment arm 11, the free end of which is provided with the support roller 12.

Underneath the roller 10, a slide or carriage 13 is slidably arranged on the ram 7. The carriage 13 is biased by the tension spring 14 in the upward direction, the spring originating from the lower side of the pedestal 9. The carriage 13 receives an abutment limitation in the upward direction by means of the head 15 of the screw 16, the latter extending from the lower pedestal 8. Leaf springs 17 are arranged on both sides of the carriage 13, the leaf springs 17 carrying the tong jaws or clamping fingers 18 on their ends.

The pedestal 8 furthermore is the carrier of the screw 19, the head 20 of which limits the downward displacement of the carriage 13, which carriage 13 is carried along by the upper tool 21. The downward displacement of the carriage 13 results in the upper tool 21 stepping against the inner flanks of the clamping fingers or jaws 18.

The working stroke of the ram 7 is achieved by means of the fork-shaped wedge 22. On the lower side the two legs of the fork form two inclined surfaces 23, 24 which are connected to one another such that the steeper inclined surface 23 lies in the range of the point or peak of the wedge. The upper side of the leg of the fork, which upper side lies opposite to these inclined surfaces, serves as a support plane 25. The latter steps against the abutment 26 on the machine side, which abutment is formed as a roller body. The steeper inclined surface 23 to the contrary is located in a contacting or engagement position on the roller 10 in the normal or starting position of the drive.

The piston rod 27 of the pneumatic cylinder 28 acts or engages on the wedge 22, the pneumatic cylinder receiving its support by the pedestal 29 on the side of the machine.

The support roller 12 of the abutment arm 11 is acted on by the angle lever 31, the latter swinging about the stationary bolt 30. The return spring 32 of the ram acts on the angle lever 31. The angle lever 31 with the coupling rod 33 which extends from the latter form the transmission connecting rod for the workpiece insertion or feed-in sliders 34 and 35,—see FIG. 5. The workpiece insertion slider 34 brings the upper parts 36 to the clamping fingers 18, while the workpiece insertion slider 35 which is located thereunder, shifts the lower parts 37 toward the lower tool 6. For this purpose the upper workpiece insertion slider 34 projects into a longitudinal recess 38 of the guide rail or ledge 39, the latter receiving the upper part 36, the ledge 39 extending up to the clamping fingers 18. The workpiece insertion slider 34 is rigidly connected with the carrier or driver 40, with the transverse carrier 41 and with the rail 42. The rail 42 is equipped on the end which points toward the clamping fingers 18 with the actuation finger 43. A tension spring 44 acts or engages on the rail 42, which tension spring biases the rail 42 and consequently also the workpiece insertion slide 34 in the direction of the clamping fingers. The driver pin 45 extends the rail 42, which pin 45 is supported on the rear surface of the guide block 46, the latter being connected with the coupling rod 33.

The lower workpiece insertion slider 35 also has a carrier or driver 47, the latter being rigidly connected with the rail 49 by means of the transverse carrier 48. Likewise a tension spring 44 acts on this rail 49, which tension spring spring biases the rail in the direction of the lower tool 6. Moreover this rail 49 also carries an abutment pin 45, the latter stepping against the rear surface of the guide 46. The front end of the rail 49 is equipped with the actuation finger 50. By means of the actuation fingers 43, 50, consequently it is possible to shift back the rails 42 and 49, respectively, out from the position according to FIG. 2, independent of the transmission connection rod 31, 33.

The guide ledge 39 is carried by the supports 51 and 52 of the arm 5.

For the lower workpiece lead-in insertion slider 35, likewise a guide ledge 53 is provided, which guide ledge receives the lower part 37. The upper and lower parts are supplied to the guide ledges 39, 53 via the feed rails 54 and 55. The feed rail 54 serves for transporting the upper parts 36, the latter being provided with a pin 36', whereas the feed rail 55 carries the lower parts 37.

The two guide rails 54, 55 stand in connection with the storage chambers 56, 57, the latter being arranged one above the other in the form of floors. A single slider 59 which is moveable up and down is coordinated to both of the chambers 56, 57 in front of the inclined aligned rear wall 58.

The slider comprises three layers 60, 61 and 62 which are rigidly connected to one another. The slider 59 is equipped on its forward wide surface with stroke- and sorting ledges 64 and 65 which are inclined sloping downwardly in the direction of the one side wall 63.

In particular the lift- and sorting ledge 64 is formed from the free upper end of the layer 61. The ledge 64 is made such that the lower parts 37 which are located in the storage chamber 56 load or lay-in according to FIG. 4. The other stroke- and sorting rail or ledge 65 extends on the upper end of the layer 62 and serves for reception of the upper parts 36, the latter being provided with the pin 36'.

The piston rod 66 of the pneumatic cylinder 67 acts on the layer 62. The stroke of the piston rod 66 is chosen so large that in the upper position of the slider, compare FIG. 3, the delivery-sided end of the sorting ledges 64, 65 is flush in alignment with the discharge openings 68 and 69, respectively, of the side wall 63. The discharge openings 68, 69 are adjusted to the shape of the upper parts and lower parts. Moreover the discharge openings 68 and 69 are arranged such that the feed rails 54 and 55, respectively, the latter originating from the discharge openings, receive the parts in perpendicular rolling position. The discharge openings 68, 69 are preferably located in exchangeable profile pieces 70 and 71, respectively, of the side wall 63.

As FIG. 4 shows, the stroke and sorting ledges 64, 65 are plunged or penetrate into the floor or bottom 72 and 73, respectively, of the storage chamber 56 and 57, respectively, in the lower reversing position of the slider movement, in order to guarantee a discharge without leaving any remainder.

The lower storage chamber 57 is open toward the top by means of a filling shaft 74, the latter extending in front of the upper storage chamber 56.

In the upper position of the slider 59 the upper parts 36 arrive in front of the discharge opening 69 in the side wall 63. From there the upper parts 36 roll in the downwardly sloping section 54' of the feed rail 54. However a turn of the upper parts 36 is required such that the upper part is fed to the tongs such that the pin 36' thereof projects downwardly. For this purpose on the transfer position between the inclined downwardly sloping section 54' and the vertical section 54'' there is provided a turn position 75, the latter being equipped with a helical-shaped track guide.

The following manner of operation occurs. Starting from the position according to FIG. 2, the workpiece insertion sliders 34, 35 already place an upper part and a lower part into the clamping fingers 18 and the lower tool 6, respectively. Subsequently the hydraulic cylinder 28 steps into action after pressing down the foot lever 3. The steeper inclined surface 23 acts on or engages the roller 10 of the ram 7 and displaces the ram 7 in the downward direction, and indeed in the quick stroke. By means of the upper tool 21, which is applied or inserted on the lower end of the ram 7, the clamping fingers 18 and consequently the slide 13 are moved therewith. The displacement of the slide 13 is limited when it abuts or sits on the head 20 of the screw 19. The wedge 22 however displaces the ram 7 further downwardly. By means of the upper tool 21, the clamping fingers 18 are spread apart from one another. The actual connecting operation of the upper part and lower part 36, 37 now starts. During this connection phase the less inclined sloping surface 24 of the wedge 22 operates.

Simultaneously with the downward displacement of the ram 7, the support roller 12 moves the transmission connection rods 31, 33 in the position according to FIG. 3. By means of the abutment pins 45 the glide block 46 has shifted the rails 42, 49 and consequently the workpiece introduction sliders 34 and 35, respectively, back, so that, respectively, each one upper part and lower part, respectively, can enter the guide ledges 39 and 53, respectively.

Simultaneously with the return stroke of the wedge 22, by means of the tension spring 32, the transmission connection rods 31, 32 and also the ram 7 arrive back into their starting position according to FIG. 2, whereby by means of the workpiece introduction sliders 34, 35, the latter being moved forwardly by the tension springs 44, one upper part and lower part 36, 37 each is placed into the tongs 18 and the lower tool 6, respectively. During this working period the slider 59 moves upwardly and downwardly and by means of the stroke- and sorting-ledges 64, 65, brings the upper- and lower-parts 36, 37 in front of the discharge openings 68, 69, respectively, of the side wall 63.

Even the improvement of FIGS. 6–11 has the machine stand 2'. The machine housing 4' is mounted on the stand 2'. The machine housing contains the projecting arm 5', the latter carrying the lower tool 6' on the front end.

The ram 7 which carries the upper tool 21 extends flush in alignment with the lower tool. The ram obtains its stroke now by means of two driving-electromagnets 76 and 77 which have different intensities whereby the weaker electromagnet 76 is coordinated to the ram.

The upper parts 36 of the rivets are conducted to the upper tool 21 via the feed rail 78 and the lower parts 37 of the rivets are conducted via the feed rail 79. Both feed rails 78 and 79 stand in connection with the magazine or storage 80, the latter being slopingly aligned and secured to the machine housing 4'. The slide 59' is guided moveably up and down in the longitudinal center plane of the magazine. The slide comprises the center transverse wall 81, which has a lower yoke 82. The piston rod 66' of the pneumatic cylinder 67' engages this yoke. For example it can be the crankshaft of an electromotor. The slide is biased in the upward direction by means of tension springs 83. In the event a rivet part is clamped between the slide 59' and the stationary walls, the piston rod 66' or crankshaft continues to move upwardly, while the clamped slide 59' remains still. During the downward movement the slide is carried therealong, and the clamping is released in a manner without causing damage. An adjustable abutment stop 84 limits the upward movement of the slide 59'.

The slide carries the layers 85, 86 and 88 on both sides of the center wall. The layers 85, 86 in addition project over the layers 87, 88. The upper ends of the layers 85, 86, 87 and 88 form the stroke and sorting ledges 89, 90, 91 and 92 for the correspondingly shaped rivet parts. The magazine chambers 93 and 94 which are arranged one above the other are coordinated to one of the wide faces of the slide 59. The stroke and sorting ledges 85 and 87, respectively, move inside of these chambers 93 and 94.

Likewise the magazine chambers 95 and 96 which are arranged one above the other are coordinated to the rear side of the slider, which rear side lies opposite the previously named wide face, the slider forming the stroke and sorting ledges 90 and 92. With the embodiment example only the chambers 93 and 94 stand in connection with the feed rails 78 and 79. For this purpose two profile members 97 and 98 are coordinated to the side wall 63', the latter being in common to all magazine chambers. The upper profile member 97 contains the discharge opening 97' for the upper parts of the rivets, while the other profile member 98 forms the discharge opening 98' for the lower parts 37 of the rivets. The discharge openings moreover are adjusted to the cross-sectional shape of the rivet parts 36, 37.

The guide stay 99 for the slide 59' extends on the narrow edge which is opposite to the side wall 63'. Magazine chamber-side walls run in the plane of the guide stay 99, the magazine chamber-side walls being selectively closeable and parallel to the side wall 63'. In addition one transverse wall 100 each is coordinated to two opposite magazine chambers 93, 95 and 94, 96, respectively. Each transverse wall 100 contains a longitudinal slot 101. a set or locking screw 102 is inserted into the longitudinal slot 101 and engages in the guide stay 99. This embodiment allows the transverse wall 100 to be able to be shifted or adjusted in height with respect to the magazine bottom 103. Moreover the reversing or turning the transverse wall 100 around 180° is possible. Each transverse wall 100 extends in its respectively prevailing position up to the outer wall 104, which opposite outer walls 104 are made of transparent material.

On the other side of the guide stay 99 there is located a transfer chamber 105, the latter respectively being able to be separated off or partitioned from one or the other magazine chamber by means of the transverse wall 100 while leaving free a reduced passageway cross-section.

The back walls of the transport chambers 105, the latter being arranged one above the other, in addition are constructed as filling and discharging flaps 106. Each flap 106 pivots about the axle 107 on the lower side. Moreover the flap forms bent-off segment walls 108. If the flaps 106 are pivoted into the open position, the magazine chambers either are filled or emptied.

The stroke and sorting ledges 89 to 92 likewise are adjusted to the shape of the rivet parts. For example if corresponding rivet parts are intended to be fed by means of the stroke and sorting ledges 90, 92, the transverse walls 100 are to be reversed or turned around, and indeed into the dot-dashed illustrated position according to FIG. 9. Then other profile members are to be provided and correspondingly adjusted feed rails 78 and 79 are to be attached, which rails stand in connection with the magazine chambers 95 and 96 via the profile members. The rivet parts then arrive via the magazine chambers 93, 94 and the transfer-chambers 105 to the opposite magazine chambers 95 and 96, respectively. The rivet parts must thereby pass or cross the passage cross-section between the transverse wall 100 and the magazine floor 103 so that the filling level, which is indicated in curved dashed-dotted lines in FIG. 7, in that magazine chamber which stands in connection with the feed rail 78, 79, is always so large so that the feeding of the rivet parts is not impaired.

FIGS. 10 and 11 illustrate that the stroke and sorting ledges have a different cross-sectional shape, which shape is adjusted to the corresponding rivet parts.

In the upper abutment-limited position, the stroke and sorting ledges are flush in alignment with the discharge openings 97', 98' of the profile members 97 and 98, respectively, so that then the rivet parts can roll from the slopingly aligned stroke and sorting ledges into the feed rails and arrive at the work tools.

We claim:

1. A machine for the attachment of rivets, buttons, or the like, particularly to clothing pieces, with an upper tool and a lower tool and with magazine chambers for upper parts and lower parts, from which chambers the upper and lower parts, respectively, are brought via feed rails into the region of the working position, comprising a magazine having side walls, a rear wall and a front wall, defining at least two magazine chambers arranged in levels one above the other, at least one of said walls being formed with discharge openings communicating with said magazine chambers, respectively, a single slide being coordinated to both of said chambers, said slide being mounted in said magazine moveably up and down in front of said rear wall, said slide having a front side defining a wide surface, stroke and sorting ledges on said wide surface of said slide, said ledges being inclined downwardly in a direction of said one side wall, said ledges being disposed in an upper position of said slide flush in alignment with said discharge openings of said one side wall.

2. The machine according to claim 1, further comprising feed rails extending from said discharge openings and adapted to receive the parts in vertical rolling position.

3. The machine according to claim 2, wherein said feed rails each have a downwardly inclined section communicating with one of said discharge openings and a vertical section, one of said feed rails including a range of transition from said downwardly inclined section to said vertical section thereof forming a turning position constituting a helical track guide.

4. The machine according to claim 1, further comprising profile members formed with said discharge openings, said profile members being exchangeably removeably mounted in said at least one side wall.

5. The machine according to claim 1, wherein said magazine chambers constitute an upper magazine chamber and a lower magazine chamber, said lower magazine chamber opening upwardly defining an upwardly opening fill-up shaft, the latter passing in front of said upper magazine chamber.

6. The machine according to claim 1, further comprising floors, respectively, defining bottoms for said magazine chambers, said ledges in a lower reversing position of movement of said slide penetrating into said floors, respectively, of said magazine chambers.

7. A machine for the attachment of rivets, buttons, or the like, particularly to clothing pieces, with an upper tool and a lower tool and with magazine chambers for upper parts and lower parts, from which chambers the upper and lower parts, respectively, are brought via feed rails into the region of the working position, comprising a magazine having side walls, a rear wall and a front wall, defining at least two magazine chambers arranged in levels one above the other, at least one of said side walls being formed with discharge openings communicating with said magazine chambers, respectively, a single slide being coordinated to both of said chambers, said slide being mounted in said magazine moveably up and down in front of said rear wall, said slide having a front side defining a wide surface, stroke and sorting ledges on said wide surface of said slide, said ledges being inclined downwardly in a direction of said one side wall, said ledges being disposed in an upper position of said slide flush in alignment with said discharge openings of said one side wall, said slide further has a narrow edge, and a rear side opposite said front side, additional downwardly inclined stroke and sorting ledges on said rear side of said slide, said slide being disposed between said front and rear walls defining opposite of said magazine chambers on both opposite sides of said slide, one of said side walls in each of said magazine chambers is respectively coordinated to one of said stroke and sorting ledges on both sides of said slide and is selectively closeable, wall means defining a transfer chamber communicating with said opposite magazine chambers adjacent to both said opposite magazine chambers on the other side of the narrow edge of said slide remote from said opposite magazine chambers, a transverse wall means for being turnable around relative to said opposite magazine chambers, respectively, for separating said transfer chamber alternately from one of said opposite magazine chambers respectively while leaving a reduced passage cross-section free between one of said opposite magazine chambers and said transfer chamber.

8. The machine according to claim 7, wherein said transverse wall is adjustable in height, said reduced passage cross-section is variable by displacement of the height of said transverse wall.

9. The machine according to claim 7, wherein said wall means of said transfer chamber is formed as a filling and emptying flap.

10. The machine according to claim 7, wherein said ledges constitute upper and lower ledges respectively disposed in upper and lower of said magazine chambers, one of said upper and lower ledges is inclined to said discharge opening and the other of said upper and lower ledges is inclined to said transfer chamber.

* * * * *